US008448822B2

(12) United States Patent
Rousselet

(10) Patent No.: US 8,448,822 B2
(45) Date of Patent: May 28, 2013

(54) DEVICE FOR PACKAGING A PRODUCT

(75) Inventor: Guilhem Rousselet, Saint Maur des Fossés (FR)

(73) Assignee: L'Oreal, Paris (FR)

( * ) Notice: Subject to any disclaimer, the term of this patent is extended or adjusted under 35 U.S.C. 154(b) by 1041 days.

(21) Appl. No.: 11/822,913

(22) Filed: Jul. 11, 2007

(65) Prior Publication Data

US 2008/0023491 A1 Jan. 31, 2008

Related U.S. Application Data

(60) Provisional application No. 60/831,665, filed on Jul. 19, 2006.

(30) Foreign Application Priority Data

Jul. 11, 2006 (FR) ..... 06 52917

(51) Int. Cl.
*B67D 7/78* (2010.01)

(52) U.S. Cl.
USPC ..... 222/131; 222/256; 215/12.1

(58) Field of Classification Search
USPC ..... 222/131, 142.5, 475.1, 95, 105, 256, 222/386.5; 220/23.87, 23.89, 573.4; 206/514; 215/12.1; 24/288
See application file for complete search history.

(56) References Cited

U.S. PATENT DOCUMENTS 2,076,549 A * 4/1937 Conner ..... 215/6
2,728,494 A * 12/1955 Hobson ..... 222/386.5
2,859,085 A * 11/1958 Morrison ..... 215/12.1
3,023,925 A * 3/1962 Sher ..... 220/786
3,096,897 A * 7/1963 Hansen ..... 215/12.2
3,156,279 A * 11/1964 Grebowiec et al. ..... 215/12.1
3,311,248 A 3/1967 Marchant
3,871,543 A 3/1975 Chadfield et al.
4,240,560 A * 12/1980 Carluccio ..... 215/12.1
4,429,798 A * 2/1984 Borows ..... 215/12.1
5,590,782 A 1/1997 Haber et al.
5,901,882 A * 5/1999 Siegel ..... 222/131
5,961,005 A * 10/1999 Pichonnier et al. ..... 222/386
6,085,927 A 7/2000 Kusz
6,918,507 B2 * 7/2005 Watanabe ..... 220/786
6,983,864 B1 * 1/2006 Cagle ..... 222/131

FOREIGN PATENT DOCUMENTS

DE 20 2004 009 460 U1 12/2004
FR 2 715 354 A1 7/1995
FR 2 715 384 A1 7/1995
FR 2 870 439 A1 11/2005

OTHER PUBLICATIONS

French Search Report for FR 0652917, dated Mar. 20, 2007.

* cited by examiner

*Primary Examiner* — Kevin P Shaver
*Assistant Examiner* — Daniel R Shearer
(74) *Attorney, Agent, or Firm* — Novak Druce Connolly Bove + Quigg LLP

(57) ABSTRACT

Various embodiments of a device for packaging a product are disclosed. Certain embodiments of the device may include an external shell having a neck and a container forming at least one housing adapted to receive the product. The container may be disposed inside the external shell. The device may also include a closure member configured to be coupled to the container to close an opening of the container. The external shell may include a through-hole formed through the neck of the external shell, and the container may include an exterior flange extending from an external surface of the container. The exterior flange may be configured to engage the through-hole of the external shell to retain the container in the external shell.

20 Claims, 3 Drawing Sheets

DEVICE FOR PACKAGING A PRODUCT

This application claims benefit under 35 U.S.C. § 119(e) of U.S. Provisional Application No. 60/831,665, filed on Jul. 19, 2006, which is incorporated herein by reference.

The present invention relates to devices for packaging a product. In particular, various exemplary embodiments consistent with the present invention relate to packaging devices having an external shell for aesthetically packaging a cosmetic product. For example, the external shell may be chosen to define the aesthetics of the packaging device, while a container disposed in the external shell may provide desired storage conditions for the product.

The term "cosmetic product," as used throughout the description including the claims, has a meaning that encompasses the definition of a cosmetic product in Council Directive 93/35/EEC of Jun. 14, 1993.

There are various packaging devices that use their external shells for the aesthetics of the external appearance. For example, U.S. Pat. No. 3,871,543 discloses a container retained in an external shell having a lateral wall, where the container has, on its exterior perimeter, a rib intended to cooperate in a clipping fashion with a complementary projection formed on the interior perimeter of the lateral wall.

French Patent No. 2715384 discloses a packaging device having a container removably mounted inside an external shell and a lid for closing the container. The external shell has a shape of a truncated hemisphere, and the lid has a complementary hemisphere shape. The container features two diametrically opposed lugs for cooperating with two notches formed on the exterior perimeter of the neck of the external shell.

There exists a need for further improving such packaging devices. In particular, there exists a need for a device that is relatively inexpensive to manufacture and easy to assembly. In addition, there is a need for an improved attachment mechanism for securely attaching a container to an external shell without compromising the aesthetic appearance of the packaging device.

Although the present invention may obviate one or more of the above-mentioned needs, it should be understood that some aspects and embodiments of the invention might not necessarily obviate one or more of those needs.

In the following description, certain aspects and embodiments will become evident. It should be understood that the invention, in its broadest sense, could be practiced without having one or more features of these aspects and embodiments. It should also be understood that these aspects and embodiments are merely exemplary.

In one aspect, as embodied and broadly described herein, a device for packaging a product may comprise an external shell having a neck and a container forming at least one housing adapted to receive the product. The container may be disposed inside the external shell. The device may also comprise a closure member configured to be coupled to the container to close an opening of the container. The external shell may include a through-hole formed through the neck of the external shell, and the container may include an exterior flange (e.g., a lateral exterior step) extending from an external surface of the container. The exterior flange may be configured to engage the through-hole of the external shell to retain the container in the external shell.

In at least some embodiments, the device may have a relatively thin attachment area between the container and the external shell. Consequently, the thicknesses of the walls of the external shell and the container may be limited, and/or the distance between the external shell and the container may be limited.

In another aspect, the exterior flange may be annular, and the neck of the external shell may define a recessed internal surface in a portion other than an area in which the through-hole is formed. Thus, it may not be necessary to index the position of the container relative to the position of the external shell when assembling the container into the external shell.

According to still another aspect, the closure member may comprise a skirt covering the through-hole when the closure member is coupled to the container. Thus, the aesthetic appearance of the device may not be affected by the attachment members provided between the external shell and the container. In addition, even if the neck is deformed or crushed during insertion of the container into the external shell, such deformations can be hidden or masked by the skirt.

In some aspects, the neck may include at least two through-holes diametrically opposed to one another with respect to a longitudinal axis of the external shell. This configuration may allow the neck to deform in an area between the two opposed through-holes during insertion of the container into the external shell. For example, if the neck has a circular shape, the neck may deform into an oval shape during insertion of the container, with the distance between the two diametrically opposed through-holes defining the major axis of the oval shape. After the flange engages the through-holes, the neck may return to its original shape.

In another aspect, the external shell may be formed by molding. For certain components that require more detailed structural features (e.g., in the region of the neck of the external shell), a shell mold or a mold having multiple sliding pieces may be used to produce components with accurate dimensions and small manufacturing tolerances.

The container may also be formed by molding. Like the external shell, a shell mold or a mold having multiple sliding pieces may be used, in particular for forming the flange.

By using shell molds or molds with multiple sliding pieces, the attachment surfaces between the external shell and the container may be formed with a great structural detail (e.g., substantially perfect flat surfaces, substantially perfect defined orientation, sharp corners or extremities, etc.). Thus, the flange and the through-hole may have respective attachment surfaces having the desired flatness, orientation, and/or sharp edges to ensure firm attachment therebetween. Use of such molds may also alleviate the defects caused by forcible extraction of the molded object from the mold, which may potentially cause the attachment surfaces to have uneven surfaces, uncertain orientation, and rounded edges.

In cases where manufacturing accuracy is desired, the assembly tolerances and the clearance between two parts to be assembled can be greatly reduced by using the shell mold or the mold with multiple sliding pieces, when compared to the cases where the objects are forcibly removed from the mold. Moreover, the quality of the attachment between the external shell and the container can also be improved. For example, the faces of the flange of the container and the perimeter surface of the through-hole can be brought directly into contact, so that they can lie one against the other in a contact plane substantially perpendicular to the axis along which the container is mounted into the external shell.

According to still another aspect, the external shell may be formed of a substantially transparent material (e.g., a plastic material). Examples of suitable materials may include, but not be limited to, a styrene polymer, such as polystyrene, copolymers of styrene and butadiene (SBS) or statistical copolymers of styrene and acrylonitrile (SAN). Alternatively or additionally, the external shell may be formed of a polymer of polyethylene terephthalate (PET), a polymer of polyethylene naphthalate (PEN), or a copolymer of these two polymers. The external shell may also be made from a polymer of cyclohexadiene terephthalate glycol (PCTG) or a polymer of polyamide.

To make the external shell, all choices of materials are possible, provided that there are no constraints to be complied with concerning compatibility of the material(s) of the external shell with the product contained in the container.

The flange may include a first face radially extending from an exterior surface of the container and a second face extending from the external surface of the container at an inclined angle, so as to facilitate insertion of the container into the external shell and to facilitate placement of the flange in the through-hole. When viewed in a cross-sectional plane along the longitudinal axis of the device, the flange may have a shape of a harpoon.

The through-hole may be formed in the neck, so that it passes through the neck in a direction substantially perpendicular to an insertion direction of the container into the external shell. At least an upper face of the through-hole, against which the flange engages, may lie in a plane substantially perpendicular to the insertion direction.

In one aspect, a thickness of the neck in a portion other than the area in which the through-hole is formed is less than a difference between a thickness of the neck in the area of the through-hole and a thickness of the flange (e.g., with each of these thicknesses being in a respective radial direction). These thickness variations can modify the interior surface of the neck, without modifying the exterior surface of the neck, which may remain circular, for example.

According to another aspect, the neck may extend upwardly from a portion of a lateral wall of the external shell, and a thickness of the lateral wall may be approximately equal to the sum of a thickness of the neck and a thickness of a skirt of the closure member (e.g., with each of these thicknesses being in a respective radial direction). Therefore, when the closure member is mounted on the container, the lateral skirt of the closure member can be inscribed by the same generatrix as that of the lateral exterior surface of the external shell.

In one exemplary embodiment of the invention, the flange may have a thickness of about 0.4 mm, as measured from the external surface of the container, and the neck may have a thickness of about 1 mm in an area in which the through-hole is formed and a thickness of about 0.6 mm in an area other than the area of the through-hole. The skirt of the closure member may have the thickness of about 1 mm.

According to some exemplary aspects, the closure member may include a skirt extending in a direction substantially parallel to a lateral wall of the external shell, and the skirt may be defined by a generatrix substantially identical to that of an exterior surface of the lateral wall.

In another exemplary aspect, the closure member may include a sealing lip configured to press against an interior surface of the container when the closure member is mounted on the container. The container may be configured such that the flange is positioned at a first axial level, different from a second axial level at which the fixing members are positioned. The second axial level may be different from a third axial level against which the sealing lip is pressed. Thus, the sealing lip may be adapted to come into contact with the third axial level, which has a constant radial thickness over the entire circumference of the container. The seal can therefore be substantially guaranteed.

Where appropriate, if the closure member is mounted permanently on the container, it may be provided with mutually cooperating members disposed between the external shell and the closure member to immobilize them against rotation relative to each other.

In another exemplary aspect, the closure member may be configured to press against the neck when the closure member is mounted on the container. In some exemplary aspects, the closure member may be coupled to the container via screw fastening. Alternatively or additionally, the closure member may be configured to deflect so as to engage the external surface of the container (e.g., the closure member may be retained to the container by stretching over the exterior surface of the container).

In still another exemplary aspect, the external shell may comprise a first engaging member, and the closure member may comprise a second engaging member configured to engage the first engaging member. When the first engaging member and the second engaging member engage one another, rotational movement between the external shell and the closure member may be substantially prevented.

According to one exemplary aspect, the device may further comprise a dispensing device coupled to the closure and configured to dispense the product out of the container. In certain exemplary aspects, the dispensing device may comprise a pump, e.g., a pump with no air inlet. In some embodiments including a pump with no air inlet, the container may be formed of a rigid lateral walls and a piston may be disposed inside the container. In other alternative embodiments, the container may be formed with a flexible, deformable wall that may collapse as the product is dispensed out of the container.

The accompanying drawings, which are incorporated in and constitute a part of this specification, illustrate a number of non-limiting embodiments of the invention and together with the description, serve to explain the principles of the invention.

Figure 1:
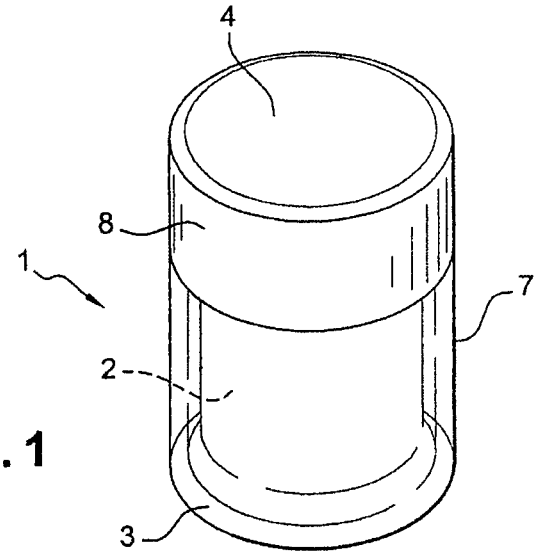
FIG. 1 is a perspective view of a packaging device, according to an exemplary embodiment of the invention.

Reference will now be made in detail to the exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

FIGS. 1 through 4 show a packaging device 1, according to an exemplary embodiment consistent with the invention. The device includes a container 2 for containing a product P (e.g., a cosmetic product to be applied to the skin, hair, and/or nails) and an external shell 3 for receiving the container 2. The device may also include a closure member 4 for closing an opening 5 of the container 2. The product P may be in any form, such as, e.g., a flowable liquid, cream, paste, powder, or cake.

Figure 2:
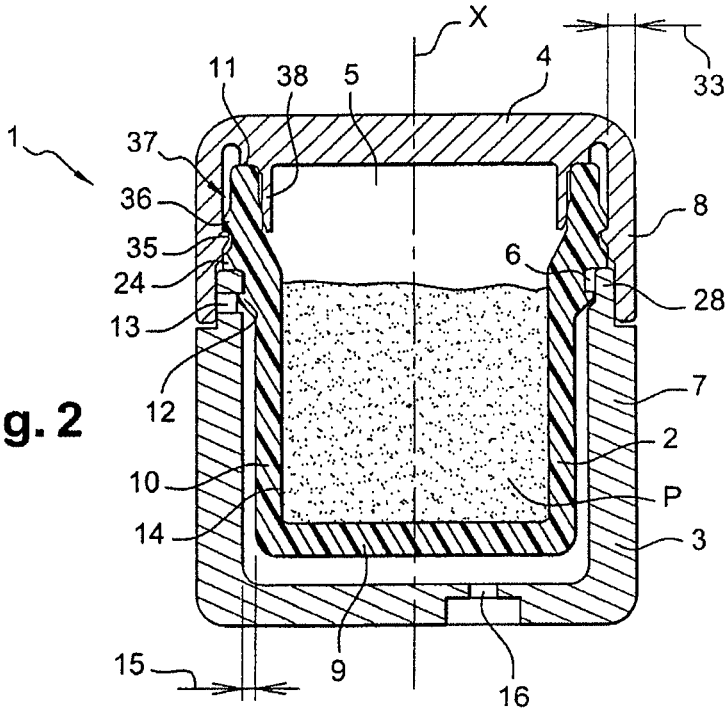
FIG. 2 is an axial cross-sectional view of the packaging device of FIG. 1.

As shown in FIG. 2, the external shell 3 includes a lateral wall 7 defining a top opening 6 and an internal space for receiving the container 2. The opening 5 of the container 2 may be concentrically aligned with the top opening 6 of the external shell 3. The container 2 may be received, either permanently or removably, inside the lateral wall 7 of the external shell 3 by, for example, moving the container 2 relative to the external shell 3 along a longitudinal axis X of the device 1, which is substantially perpendicular to the opening 6 of the external shell 3. In some exemplary embodiments, the lateral wall 7 of the external shell 3 may be substantially cylindrical, and the longitudinal axis X of the device 1 may be parallel to a generatrix of the lateral wall 7.

The external shell 3 may be made of a substantially transparent or translucent material so as to enable a user to see the container 2 at least through the lateral wall 7. In the exemplary embodiment shown in FIGS. 1 through 3, the closure member 4 may constitute a cap and may be made of an opaque material. In an alternative embodiment, at least a portion of the closure member 4 may be made of a substantially transparent or translucent material. The closure member 4 may include a substantially flat top wall and a lateral skirt 8 extending laterally from the top wall. The lateral skirt 8 may be configured in such a way that, when it is mounted on the container 2, the lateral skirt 8 of the closure member 4 and the lateral wall 7 of the external shell 3 form a substantially continuous outer surface.

The lateral wall 7 of the external shell 3 and the lateral wall 8 of the closure member 4 may have shapes similar to one another. For example, the lateral wall 7 of the external shell 3 and the lateral wall 8 of the closure member 4 may each form a circular cylinder. In an alternative embodiment, the lateral wall 7 of the external shell 3 and the lateral wall 8 of the closure member 4 may have shapes different from one another.

The container 2 has a bottom 9 oriented substantially parallel to a plane defined by the opening 5 and a lateral wall 10 extending substantially perpendicularly from the bottom 9. The lateral wall 10 includes, in the vicinity of its free edge 11 delimiting the opening 5, a fixing member 12 adapted to cooperate with a complementary fixing member 13 formed on the lateral wall 7 of the external shell 3. When the fixing member 12 of the container 2 engages the complimentary fixing member 13 of the external shell 3, the container 2 is fixed axially in the external shell 3.

The lower portion 14 of the lateral wall 10 of the container 2, opposite the free edge 11, has a shape (e.g., a circular cylinder) conforming to the shape of the lateral wall 7 of the external shell 3, and the lower portion 14 is surrounded by the lateral wall 7 of the external shell 3 in an assembled position. The lower portion 14 and the lateral wall 7 of the external shell 3 may define a clearance gap 15 therebetween. During assembly, the clearance gap 15 may facilitate insertion of the container 2 into the external shell 3. The clearance gap 15 may also provide an advantageous optical and aesthetic effect.

The external shell 3 may also include an orifice 16 positioned at its bottom wall. The orifice 16 may provide a fluid communication between atmosphere and the internal space between the external shell 3 and the container 2, such that the pressure inside the internal space may be maintained at atmospheric pressure during insertion of the container 2 into the external shell 3 and/or removal of the container 2 from the external shell 3. Where dispensing product P contained in the container 2 requires movement of the container 2 relative to the external shell 3, the orifice 16 may facilitate such a movement by maintaining the pressure inside the space between the external shell 3 and the container 2 at atmospheric pressure. It should be understood that the orifice 16 may be located at any position other than the bottom wall (e.g., at the lateral wall 7).

Figure 3:
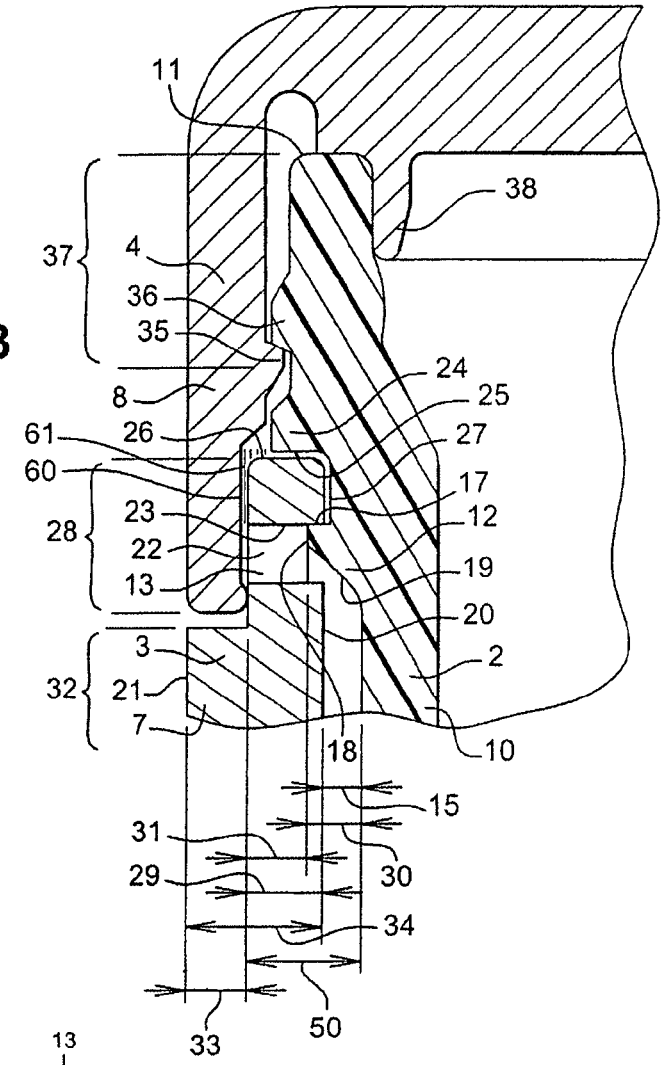
FIG. 3 is a partial cross-sectional view of the packaging device of FIG. 1, illustrating an exemplary engagement between an external shell and a container of the device.

As best shown in FIG. 3, the fixing member 12 may comprise an annular flange 12 extending radially outwardly from the lateral wall 10. In some exemplary embodiments, the flange 12 may extend continuously around the entire circumference of the lateral wall 10. The flange 12 has a radial first face 17 extending substantially perpendicularly from the exterior surface of the lateral wall 10. The first face 17 terminates at a rim 18 having a surface extending substantially parallel to the lateral wall 10. The flange 12 also includes a second face 19 extending from the rim 18 to the lateral wall 10 at an inclined angle other than 90° with respect to the lateral wall 10. As shown in FIG. 3, when viewed in a cross-sectional plane along the longitudinal axis X, the flange 12 may have a shape of a harpoon.

In a variant (not shown), the first face 17 may be slightly inclined at an angle (e.g., about 20°), extending downwardly from the rim 18 to the lateral wall 10. This configuration may create an axial clearance between the external shell 3 and the container 2.

When the container 2 is placed inside the external shell 3, the fixing member 12 cooperates with the complementary fixing member 13 of the external shell 3. The fixing member 13 may be deflectable to allow, or otherwise facilitate, engagement between the fixing member 12 of the container 2 and the complementary fixing member 13 of the external shell 3.

As shown in FIG. 3, the complementary fixing member 13 may include a raised portion defining a window 13. The window 13 may be a through-hole, passing through the lateral wall 7 between the interior surface 20 and the exterior surface 21. The circumferential surface 22 that defines the through-hole in the lateral wall 7 includes at least one face 23 aligned perpendicularly relative to the lateral wall 7. When the fixing member 12 of the container 2 engages the complementary fixing member 13 of the external shell 3, the at least one face 23 abuts against the first face 17 of the fixing member 12.

The container 2 and the external shell 3 may be manufactured by injection molding. In some exemplary embodiments, a shell mold or a mold with multiple sliding pieces may be used to obtain components with highly detailed structural features (e.g., flat faces and/or sharp corners), since such molding devices do not require deformation of the molded components during removal from the mold.

By way of examples only, the external shell 3 is made of a substantially transparent thermoplastic material, such as a statistical copolymer of styrene and acrylonitrile, and the container 2 is made of an opaque thermoplastic material of nacreous white color (e.g., polypropylene).

Once the annular flange of the fixing member 12 is engaged with the window of the complementary fixing member 13, the container 2 is fixed axially relative to the external shell 3, and an accidental separation between the container 2 and the external shell 3 does not occur under normal conditions of use. To limit axial movement of the container 2 relative to the external shell 3 when the container 2 is pressed into the external shell 3, a second flange 24 may be provided on the exterior surface of the lateral wall 10 of the container 2. The second flange 24 may be spaced at a distance from the annular flange 12 such that its lower face 25 may bear on the top free edge 26 of the lateral wall 7 of the external shell 3.

To limit lateral movements between the container 2 and the external shell 3, which may be caused by the clearance gap 15, the lateral wall 10 of the container 2 may have a recessed region 27 between the first flange 12 and the second flange 24. The recessed region 27 has a thickness greater than a thickness of the lower portion 14, such that the recessed region 27 and the lateral wall 7 define a gap narrower than the clearance gap 15. Consequently, the clearance gap 15 for facilitating insertion of the container 2 into the external shell 3 and/or enhancing the aesthetic appearance of the device 1 does not subsequently impact the immobilization of the container 2 inside the external shell 3. Ensuring immobility of the container 2 relative to the external shell 3 may be desired to give a user an impression that the user has only one article in his or her hand.

In an exemplary embodiment, to more effectively limit the lateral movement, and to reinforce the axial immobilization of the container 2 relative to the external shell 3, the external shell 3 may include a second window located diametrically opposite to the window 13. The second window may be symmetrical to the window with respect to a longitudinal axis of the external shell 3.

Figure 4:
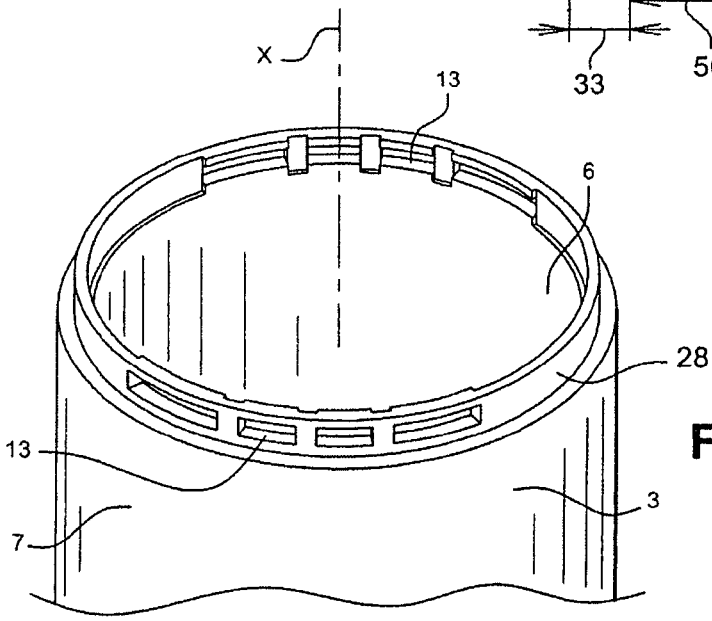
FIG. 4 is a perspective view of an external shell of a device, according to an exemplary embodiment of the invention.

In one embodiment, the lateral wall 7 of the external shell 3 may include a plurality of windows 13. For example, as shown in FIG. 4, the lateral wall 7 may form a circular cylinder and include eight windows 13 in two diametrically opposed quarters. Each quarter has four windows 13, and two of the windows 13 may be wider than the other two windows. The two wider windows 13 may bracket the other two windows between them.

Dividing the window 13 into a plurality of windows 13 may enhance the structural strength of the window 13, since the walls dividing the plurality of windows 13 may function as structural columns for distributing the load applied to the windows 13.

The windows 13 may be formed in a neck 28 of the lateral wall 7 near the free edge 26. The portions of the neck 28 that do not include any windows 13 (e.g., the two diametrically opposed quarters having no windows 13) may be configured such that they form a small clearance gap with the annular flange 12. This small clearance gap may allow deformation of the neck 28 when the flange 12 is forced into the windows 13. To facilitate this deformation, according to an exemplary embodiment, the neck 28 may be thinner in the portions that do not include any windows 13. Because of this, the exterior surface 21 of the lateral wall 7 in the region of the neck 28 may remain circular.

By way of examples only, the thickness 29 of the neck 28 in the region of the window 13 is approximately 1 mm, and the projection thickness 30 of the flange 12 is approximately 0.4 mm. The thickness 31 of the neck 28 outside the windows 13 is less than the difference between the thickness 29 of the neck 28 in the region of the window 13 and the projection thickness 30 of the flange 12. In an exemplary embodiment, the thickness 31 of the neck 28 is approximately 0.6 mm.

In at least some embodiments of the invention, the distance 50 between the exterior surface of the lower portion 14 of the container 2 and the exterior surface of the neck 28 can be minimized.

As shown in FIG. 3, the thickness 29 of the neck 28 is smaller than the thickness 34 of a portion 32 of the lateral wall 7 from which the neck 28 extends. The closure member 4 may be configured such that its lateral skirt 8 surrounds the neck 28 of the lateral wall 7 and has an exterior surface defined by the same generatrix as the exterior surface of the portion 32 of the lateral wall 7. By way of example only, the lateral skirt 8 has a thickness 33 of approximately 1 mm. The thickness 34 of the portion 32 of the lateral wall 7 may be approximately equal to the sum of the thickness 29 of the neck 28 and the thickness 33 of the lateral skirt 8. By way of example only, the thickness 34 is approximately 3 mm.

The closure member 4 closes the container 2 via a fixing member 35 formed on the interior surface of the lateral skirt 8 and a complementary fixing member 36 formed on an annular upper portion 37 of the container 2. In an exemplary embodiment, at least one of the fixing members 35, 36 may be deformable so as to allow snap-fastening of the closure member 4 onto the lateral skirt 8 of the container 2. In an alternative embodiment, the fixing member 35, 36 may include threads for screw-fastening of the closure member 4 onto the lateral skirt 8. Any other suitable fastening mechanism may be used alternatively or additionally.

The annular upper portion 37 lies between the second flange 24 and the free edge 11 delimiting the opening 5 of the container 2. The engagement between the fixing members 35, 36 takes place in an area vertically aligned with the lateral wall 7, so that the fixing of the closure member 4 onto the container 2 preserves the relatively small thickness between the container 2 and the external shell 3.

In the exemplary embodiment shown in FIGS. 2 and 3, the closure member 4 may include a sealing lip 38 for sealingly closing the opening 5 of the container 2. The lip 38 may be elastically deformed, in the closed position, making contact against the interior surface of the container 2 to prevent the product from leaking during storage. The sealing lip 38 may concentrically extend with the lateral skirt 8.

In the closed position, the lateral skirt 8 of the closure member 4 may be configured to exert a slight pressure onto the neck 28 of the external shell 3, so that its interior surface is pressed against the exterior surface of the neck 28.

In some exemplary embodiments, the closure member 4 and the external shell 3 may each have mutually engaging members (e.g., vertically extending striations 60, 61) configured to prevent rotation of the closure member 4 relative to the external shell 3.

Figure 5:
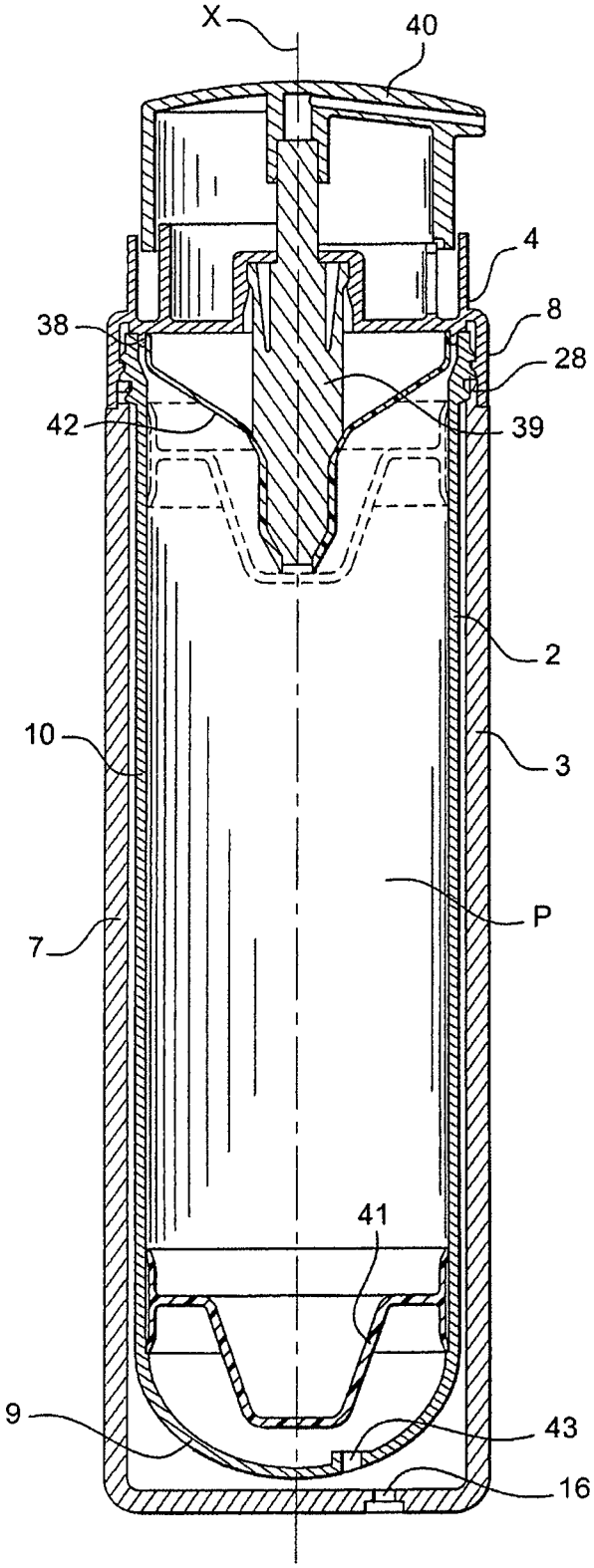
FIG. 5 is an axial cross-sectional view of a packaging device, according another embodiment of the invention.

According to another exemplary embodiment, the closure member 4 may be permanently mounted to the container 2, as shown in FIG. 5. For that purpose, the closure member 4 and the container 2 may include suitable fixing members configured to permanently engage one another (e.g., a snap fastening mechanism), so that, under normal conditions of use, the closure member 4 cannot be accidentally separated from the container 2. Alternatively or additionally, the closure member 4 and the container 2 may be bonded together. In another alternative embodiment, the closure member 4 and the container 2 may be integrally formed.

In the embodiment shown in FIG. 5, the closure member 4 may include a dispensing device for dispensing the product P contained in the container 2. The dispensing device may include a pump 39 coupled to a portion of the closure member 4 and an actuator member 40 placed on the top of the closure member 4 for selectively actuating the pump 39. In an exemplary embodiment, the pump 39 may have no air inlet, and the container 2 may include a movable piston 41 configured to rise as the volume of the product P decreases so as to maintain a constant pressure inside the container 2. To enable or facilitate the movement of the piston 41, the container 2 may include an orifice 43 that communicates with an orifice 16 of the external shell 3, so as to maintain the pressure inside the internal space between the piston 41 and the bottom 9 of the container 2 at atmospheric pressure and to prevent a build-up of a partial vacuum condition in the internal space.

The actuator member 40 may comprise a pushbutton for actuating the pump 39. When the pushbutton is actuated (e.g., pushed downwardly along a longitudinal axis X), a predetermined dose of product P may be dispensed out of the container 2 via the pump 39. During dispensing, the piston 41 inside the container 2 may rise to compensate the pressure change resulting from the dispensing of the product P. In some exemplary embodiments, to optimize emptying of the container 2, a purge ring 42 may be fitted around the body of the pump 39. The purge ring 42 may be configured to cooperate with the piston 41 to reduce the residual volume of the product P at the end of the stroke of the piston 41. The purge ring 42 may be disposed inside the sealing lip 38.

In an alternative embodiment, instead of a piston 41, the container 2 may have flexible walls so that, as the product is dispensed out of the container 2, the walls of the container 2 can collapse to reduce its volume. In another alternative embodiment, the container 2 may include an air inlet, and the orifice 43 in the container 2 may be eliminated.

Throughout the description, including the claims, the terms "comprising a" and "including a" should be understood as being synonymous with the terms "comprising at least one" and "including at least one," respectively, unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for packaging a product, comprising;

an external shell having a neck;

a container fanning at least one housing adapted to receive the product, the container being disposed inside the external shell; and a closure member configured to be coupled to the sides of the container to close an opening of container, wherein the external shell comprises a through-hole formed through the neck of the external shell, wherein the container comprises a first exterior flange extending radially outward from an external surface of the container, wherein the first exterior flange is configured to engage the through-hole of the external shell to retain the container in the external shell, wherein the container comprises a second exterior flange extending radially outward from the external surface of the container, the second exterior flange having an upward facing surface and u downward facing surface and both the upward facing, surface and the downward facing surface being disposed between an uppermost surface of the neck and an uppermost surface of the container in an up-down direction, wherein the second exterior flange is configured to engage the closure member, and wherein the closure member comprises a skirt that extends below the uppermost surface of the neck when the closure member is coupled to the container.

2. The device of claim 1, wherein the first exterior flange is annular, and the neck of the external shell defines a recessed internal surface in a portion other than an area in which the through-hole is formed.

3. The device of claim 1, wherein the skirt covers the through-hole when the closure member is coupled to the container.

4. The device of claim 3, wherein the neck includes at least two through-holes diametrically opposed to one another with respect to a longitudinal axis of the external shell.

5. The device of claim 1, wherein the external shell is formed by molding.

6. The device of claim 1, wherein the container is formed by molding.

7. The device of claim 1, wherein the external shell comprises a substantially transparent material.

8. The device of claim 1, wherein the first flange includes a first face radially extending from an exterior surface of the container and a second face extending from the external surface of the container at an inclined angle, so as to facilitate insertion of the container into the external shell and to facilitate placement of the first flange in the through-hole.

9. The device of claim 1, wherein a thickness of the neck in a portion other than the area in which the through-hole is filmed is less than a difference between a thickness of the neck in the area of the through-hole and a thickness of the first flange.

10. The device of claim 1, wherein the neck extends upwardly from a portion of a lateral wail of the external shell, and a thickness of the lateral wall is approximately equal to the sum of a thickness of the neck and a thickness of the skirt of the closure member.

11. The device of claim 10, wherein:

the first flange has a thickness of about 0.4 mm, as measured from the external surface of the container, the neck has a thickness of about 1 mm in an area in which the through-hole is formed and a thickness of about 0.6 mm in an area other than the area of the through hole, and the skirt of the closure member has the thickness of about 1 mm.

12. The device of claim 1, wherein the skirt extends in a direction substantially parallel to a lateral wall of the external shell, and the skirt is defined by a generatrix substantially identical to that of an exterior surface of the lateral wall.

13. The device of claim 1, wherein the closure member includes a sealing lip configured to press against an interior surface of the container when the closure member is mounted on the container.

14. The device of claim 1, wherein the closure member is configured to press against the neck when the closure member is mounted on the container.

15. The device of claim 1, wherein the closure member is configured to deflect so as to engage the external surface of the container.

16. The device of claim 1, wherein:

the external shell comprises a first engaging member, the closure member comprises a second engaging member configured to engage the first engaging member, and the device is configured so that when the first engaging member and the second engaging member engage one another, rotational movement between the external shell and the closure member is substantially prevented.

17. The device of claim 1, wherein the closure member is coupled to the sides of the external surface of the container via screw fastening.

18. The device of claim 1, further comprising a dispensing device coupled to the closure and configured to dispense the product out of the container.

19. The device of claim 18, wherein the dispensing device comprises a pump and wherein the device further comprises a piston disposed inside the container.

20. The device of claim 1, further comprising a cosmetic product disposed in the housing of the container.

* * * * *